United States Patent [19]

Neeb et al.

[11] 4,142,790

[45] Mar. 6, 1979

[54] DIAZOTYPE DEVELOPING APPARATUS WITH IMPROVED LIQUID METERING ASSEMBLY

[75] Inventors: Robert P. Neeb, Boca Raton, Fla.; Henry W. Patrick; Ray H. Mumford, both of Raleigh, N.C.

[73] Assignee: Diazit Company, Inc., Youngsville, N.C.

[21] Appl. No.: 870,335

[22] Filed: Jan. 18, 1978

[51] Int. Cl.[2] ..... G03D 5/06

[52] U.S. Cl. ..... 354/318; 354/324

[58] Field of Search ..... 354/317, 318, 324; 118/126, 248, 259, 261

[56] References Cited

U.S. PATENT DOCUMENTS

| | | | |
|---|---|---|---|
| 3,037,451 | 6/1962 | Davis | 118/261 |
| 3,626,833 | 12/1971 | Koch | 118/261 |
| 3,687,049 | 8/1972 | Koch et al. | 118/261 |
| 3,875,581 | 4/1975 | Yamashita et al. | 354/318 |
| 3,940,782 | 2/1976 | Neeb et al. | 118/259 |
| 4,048,919 | 9/1977 | Woods | 118/261 |

*Primary Examiner*—L. T. Hix
*Assistant Examiner*—Alan Mathews
*Attorney, Agent, or Firm*—Samuelson & Jacob

[57] ABSTRACT

Apparatus for developing exposed diazotype sheet material in which an accurately metered amount of liquid developer is applied to the sheet material by an applicator roller. The roller surface is essentially smooth and liquid developer is applied to the roller surface in an amount metered by a metering blade assembly which includes a flexible support member carrying a resilient backing layer which, in turn, carries a fine mesh screen held in contact with the smooth surface of the roller. The screen includes intersecting filaments and opposed, flattened lands on opposite surfaces of the screen and located at intersections of the filaments, the screen having a predetermined thickness between opposed flattened lands.

10 Claims, 5 Drawing Figures

DIAZOTYPE DEVELOPING APPARATUS WITH IMPROVED LIQUID METERING ASSEMBLY

The present invention relates generally to diazotype developing apparatus and pertains, more specifically, to an improved liquid metering arrangement for applying an accurately determined amount of liquid developer to a sheet of exposed diazotype material.

Recent developments in diazotype developing apparatus have emphasized the desirability of applying well-controlled, very small amounts of liquid developer to sheets of exposed diazotype material for the convenient production of immediately usable copy.

One scheme in present use for attaining such copy is to apply the liquid developer to the sheet of exposed diazotype material with an applicator roller having a resilient surface including random small depressions. Liquid developer is applied to the roller surface in excess of the desired amount and the excess fluid is wiped or scraped from the surface, leaving behind, within the random depressions, only the desired small amount of developer which is to be applied to the sheet. It is immediately apparent that control of the amount of liquid thus applied is a direct function of the size and number of the depressions in the roller surface and accuracy is obtained only through careful control in the manufacture of the roller applicator.

It would be advantageous to be able to attain accurate control of the amount of liquid developer applied to exposed sheets of diazotype material using a roller applicator, but independent of any particular requirements for depressions in the roller surface.

In an earlier patent, U.S. Pat. No. 3,940,782, we describe a liquid metering arrangement which includes a fine mesh screen in contact with a smooth-surfaced roller applicator for accurately controlling the amount of liquid developer placed on the roller surface and applied by the roller to the exposed diazotype sheet material. That arrangement works well in applying accurately determined small amounts of liquid developer, and it would be a further advantage to enable employment of a similar arrangement for accurately metering even smaller amounts of liquid developer. However, the metering of smaller amounts ordinarily would call for finer mesh screens and closer control over screen thickness to attain the desired accuracy, leading to more critical and, hence, more expensive screen constructions.

It is an object of the present invention to provide a diazotype developing apparatus with a liquid metering arrangement in which a metering blade assembly includes a fine mesh screen in contact with an essentially smooth-surfaced roller applicator for accurately controlling the amount of liquid developer placed on the roller surface and applied by the roller to exposed diazotype sheet material, the construction of the screen being modified to enable the accurate metering of very small amounts of liquid developer.

Another object of the invention is to provide apparatus of the type described and in which the metering blade assembly includes a layer of resilient material beneath the fine mesh screen for added control of the amount of liquid developer applied to the roller surface and for resiliently conforming the screen to the contour of the roller surface along a limited area thereof.

Another object of the invention is to provide apparatus of the type described and in which modification of the fine mesh screen enables the use of a more economical coarser mesh screen, rather than a more expensive finer mesh screen, for the accurate control of the application of small amounts of liquid developer.

Still another object of the invention is to provide apparatus of the type described and in which contact between the fine mesh screen and the applicator roller surface may be maintained, even when the apparatus is not in use, without the formation of deleterious depressions in the smooth surface of the applicator roller.

A further object of the invention is to provide apparatus of the type described and in which the orientation of the liquid metering arrangement tends to preclude unwanted excess liquid from bypassing the ends of the metering blade assembly to run onto the surface of the roller applicator beyond the metering blade assembly and disturb the accuracy of the amount of liquid developer metered by the assembly.

A still further object of the invention is to provide a relatively simple and economically manufactured liquid metering arrangement for applying accurately determined smaller amounts of liquid developer to exposed diazotype sheet material in a diazotype developing apparatus.

The above objects, as well as still further objects and advantages, are attained by the invention which may be described briefly as an apparatus for developing exposed diazotype sheet material by applying a predetermined amount of liquid developer to the sheet material, the apparatus comprising a frame, an applicator roller mounted for rotation in a given direction upon the frame, the roller having a generally cylindrical surface, a metering blade assembly mounted upon the frame and urged against the surface of the applicator roller, means for supplying liquid developer at a first area of the roller surface located before the metering blade assembly in a direction opposite to the given direction, and means for urging the sheet material against a second area of the roller surface located beyond the metering blade assembly in the given direction, the metering blade assembly including a fine mesh screen biased into direct contact with a portion of the roller surface between the first and second areas for metering the supplied liquid developer to establish an accurately determined amount of liquid developer upon the surface of the roller as the surface passes across the screen, the fine mesh screen including opposite surfaces, filaments intersecting at intersections along the screen, opposed flattened lands on the opposite surfaces and located on the filaments at intersections thereof, and a predetermined thickness between the opposed flattened lands.

The invention will be more fully understood, while still further objects and advantages will become apparent, in the following detailed description of a preferred embodiment of the invention illustrated in the accompanying drawing, in which.

Figure 1:
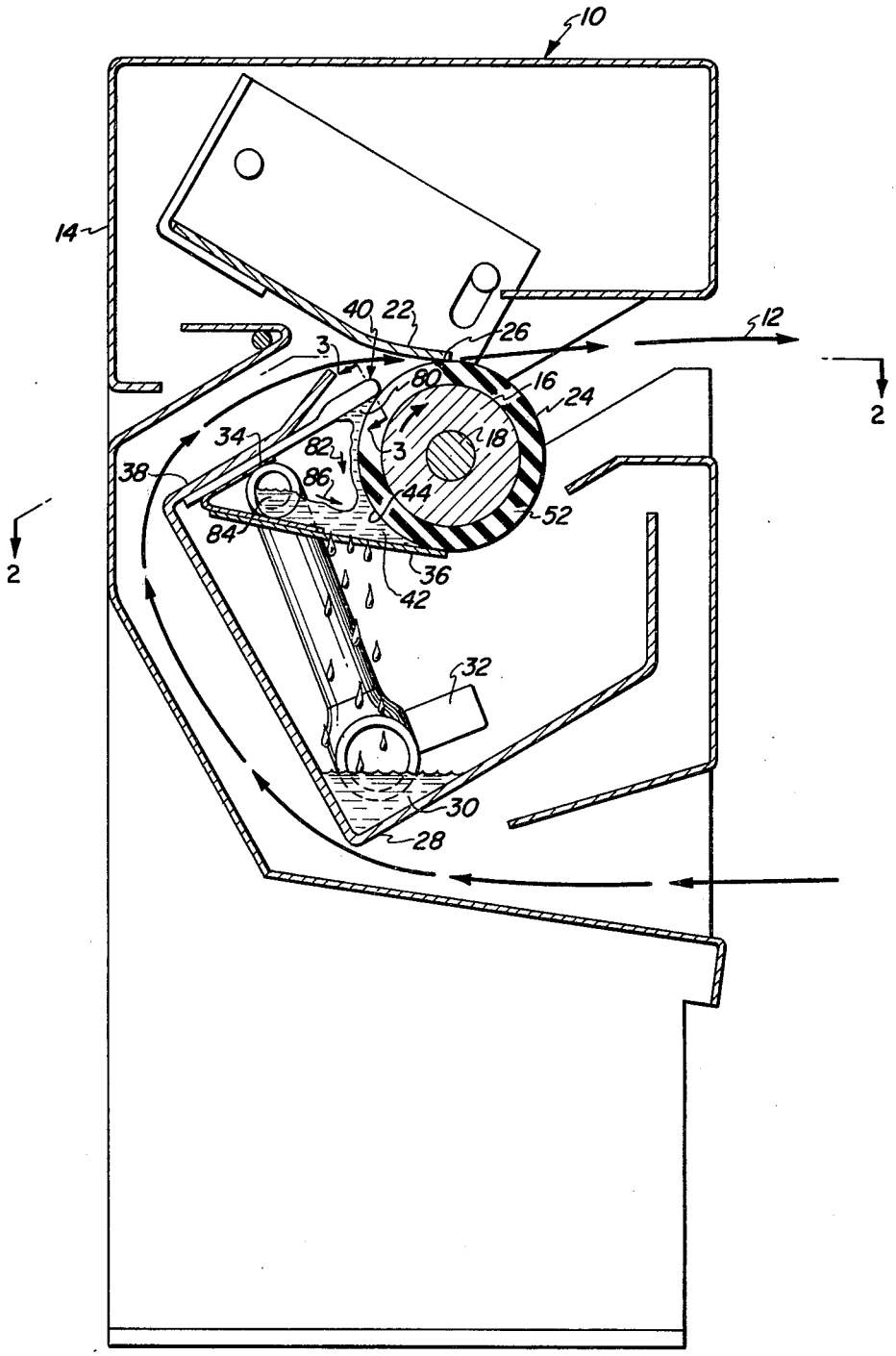
FIG. 1 is a largely diagrammatic, transverse elevational cross-sectional view of a diazotype developing apparatus constructed in accordance with the invention.
Figure 2:
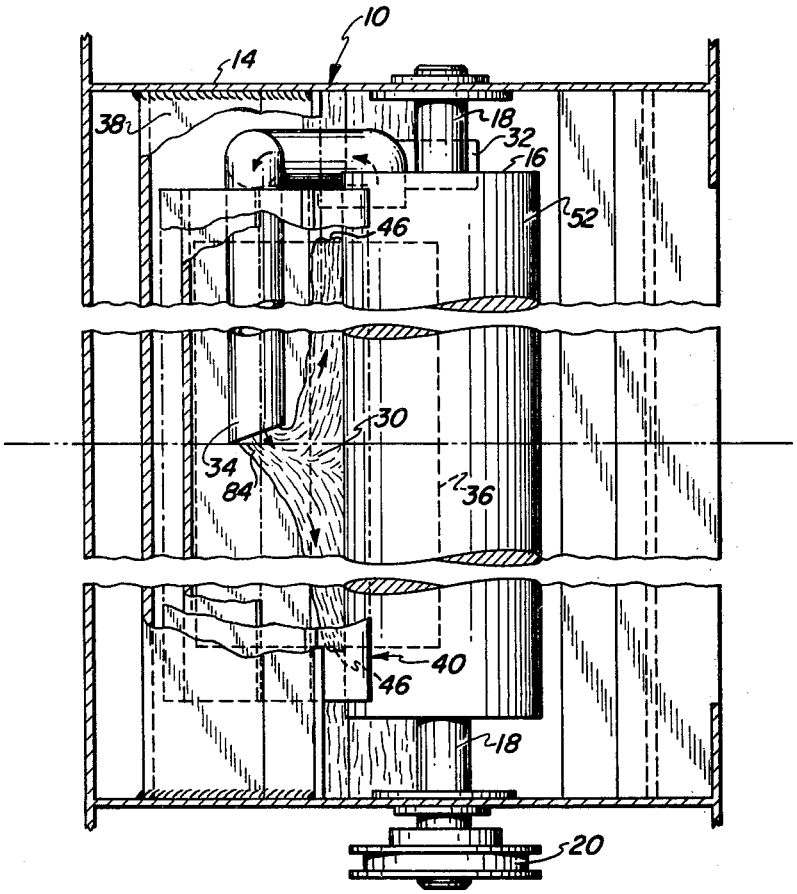
FIG. 2 is a largely diagrammatic, partially cut-away plan view of the apparatus.

Referring now to the drawing, and especially to FIGS. 1 and 2 thereof, there is illustrated, largely diagrammatically, a diazotype developing apparatus 10 for developing exposed diazo-type sheet material which follows a path of travel 12 through apparatus 10. Apparatus 10 includes a frame 14 upon which the major working components of the apparatus are mounted. Thus, an applicator for applying liquid developer to the exposed diazotype sheet material is shown in the form of an applicator roller 16 carried by a shaft 18 which is journalled for rotation in frame 14 and carries a drive pulley 20 (see FIG. 2) ordinarily driven by an electric motor (not shown) to rotate the applicator roller 16 in a clockwise direction, as indicated by the arrow in FIG. 1.

Means, shown in the form of a resilient guide blade 22 mounted upon the frame 14, is provided for urging the diazotype sheet material against the surface 24 of the applicator roller 16 at area 26 of surface 24 in such a manner that the sheet material is driven by the roller 16 along the path of travel 12 in the direction indicated by arrowheads in FIG. 1.

Means is also provided for applying a liquid developer to the surface 24 of the applicator roller 16 and is seen to include a reservoir 28 of liquid developer 30, mounted upon the frame 14, and a pump 32 for delivering the liquid developer 30 through an inlet tube 34 to a tray 36 located adjacent the applicator roller 16. Affixed to a bracket 38 is a metering blade in the form of metering blade assembly 40 which is urged against the surface 24 of applicator roller 16. A puddle 42 of liquid developer is supported on tray 36 and wets the contacted surface area 44 of the roller surface 24. A sufficient volume of liquid developer 30 is supplied by pump 32 and inlet tube 34 to maintain a puddle 42 large enough to place an adequate amount of liquid developer 30 at the surface area 44 of the applicator roller 16. Excess liquid developer 30 overflows over the ends 46 of tray 36 and drops down, as shown in FIG. 1, by gravity, back into the reservoir 28.

The metering blade assembly 40 is located between the wetted surface area 44 of the roller surface 24 and the sheet material contact area 26 of the roller surface 24 in order to enable the metering blade assembly 40 to establish an accurately determined amount of liquid developer upon the surface of the roller and to enable the roller to apply only a predetermined desired amount of liquid developer to the diazotype sheet material. The cooperation between the metering blade assembly and the surface of the roller becomes very critical where it is desired to apply very small amounts of accurately measured liquid developer to the sheet material.

It has been suggested that such very small amounts of liquid can be metered accurately by providing the roller surface with randomly formed small depressions which will become filled with the appropriate amount of liquid, any excess liquid being scraped from the remainder of the roller surface by a relatively smooth metering blade making intimate contact with the roller.

Figure 3:
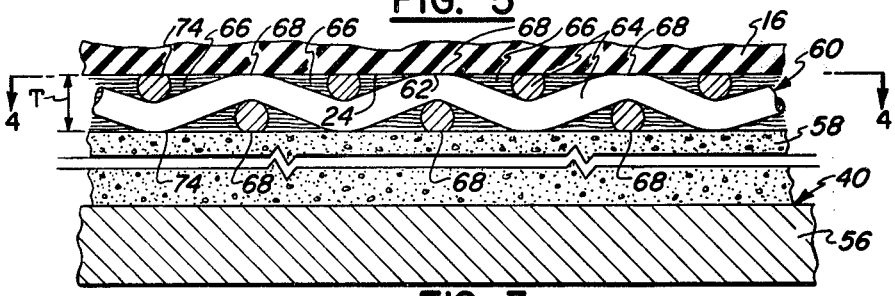
FIG. 3 is a very much enlarged fragmentary cross-sectional view taken along line 3–3 of FIG. 1.

In the present apparatus 10, the roller 16 is provided with a somewhat resilient cover 52 with a relatively smooth surface 24. Preferably, surface 24 is as smooth a surface, i.e., free of depressions, as can be obtained economically. The metering blade assembly 40 then operates to meter the liquid developer to establish accurately the appropriate amount of liquid developer upon the surface of the roller, as the roller surface emerges from contact with the metering blade assembly, by virtue of the composite structure of the metering blade assembly, which is best illustrated in FIG. 3. Thus, the composite structure of the metering blade assembly 40 includes a resiliently flexible support member 56 which carries a resilient backing member in the form of resilient layer 58 which, in turn, carries a fine mesh screen 60. The screen 60 is urged against the surface 24 of the applicator roller 16 along portion 62 of that surface with a biasing force just great enough to enable retention of the appropriate amount of liquid developer on the surface of the roller. The resilient backing layer 58 enables the screen 60 to be conformed somewhat to the portion 62 of the roller surface 24 for optimum metering.

Preferably, the flexible support member is constructed of a durable, resilient material, such as spring steel, and may be thin relative to the resilient backing layer which preferably is constructed of a foam plastic material, such as a closed cell Neoprene or silicone foam. The screen is thinner than either the flexible support member or the resilient backing layer and is woven from filaments of relatively hard material, preferably in the form of a metal such as stainless steel. In a typical metering blade assembly 40, the flexible support member 56 has a thickness of 0.005 inch, the resilient backing layer a thickness of 0.060 inch and the screen 60 has a thickness of less than 0.0025 inch.

As best seen in FIG. 3, the screen 60 is woven from filaments 64 and small passages 66 are created which enable the metering blade assembly 40 to meter the liquid developer accurately to provide the desired small amounts of liquid developer to the roller surface which then carries the appropriate amount of liquid developer to the diazotype sheet material. By employing different diameter filaments 64 and different filament spacing, the amount of liquid developer allowed to remain on the surface of the roller may be varied. Woven materials found suitable for use as screen 60 in the metering blade assembly 40 are chosen by "mesh", which indicates the number of filaments per inch, and "opening" or "wire diameter" either of which designates the size of the opening formed by the weave of a particular mesh size. Since the screen 60 preferably is woven in the form of orthogonal filaments 64, the opening is a square or rectangular opening. The wetting and self-leveling properties of the developer fluid, together with the large number of very small passages 66 provided by the screen enable the liquid developer to form a suitable thin film over the roller surface 24 between the portion 62 and the area 26 for even application to the diazotype sheet material.

Figure 4:
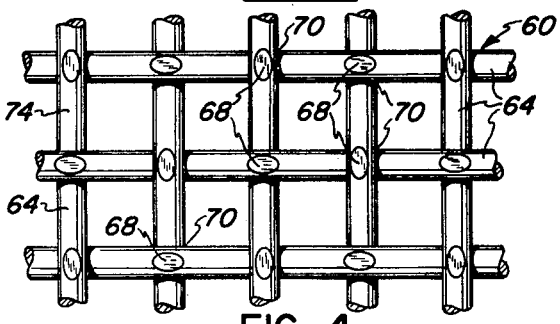
FIG. 4 is a fragmentary plan view of a portion of FIG. 3, taken along line 4—4 of FIG. 3.

In order to meter smaller amounts of liquid developer, a mesh screen is chosen with smaller diameter filaments and closer filament spacing, resulting in smaller openings and smaller passages 66. However, finer mesh screens are generally more difficult to fabricate than coarser mesh screens and consequently are more expensive. In addition, while coarser mesh screens readily are available commercially, very fine screens are not so readily available. In the present construction, the size of passages 66 is reduced by flattening screen 60 before the screen is placed within metering blade assembly 40. The "flattening" of screen 60 reduces the thickness T of the screen and effects a concommitant reduction in the size of each passage 66. At the same time, flattened lands 68 are established at the intersections 70 of the filaments 64, as best seen in FIG. 4. The flattened lands 68 increase the area of screen 60 which rests against the roller surface 24, thus diminishing the tendency to place unwanted impressions in the roller and eliminating the need for any auxiliary structure interposed between the screen 60 and the roller surface 24 when the apparatus is at rest.

Figure 5:
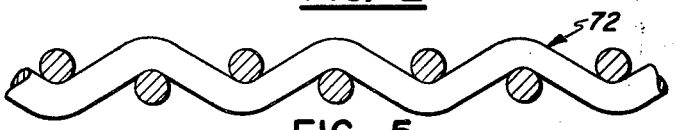
FIG. 5 is an enlarged cross-sectional view of an unmodified fine mesh screen.

Screen 60 is fabricated by starting with a standard fine mesh screen, as shown at 72 in FIG. 5, and then compressing the screen 72 between two precision hardened and ground rollers (not shown) with enough compression force to mechanically deform screen 72 into the configuration of screen 60. For example, a standard screen 72 having a wire diameter of 0.0011 inch and a total thickness of 0.0026 inch can be squeezed between precision rollers at a compression force of 2000 pounds and emerge as screen 60 having a total thickness T of 0.0018 inch, a dimension which is less than the sum of the two diameters of the filaments 64, thereby establishing the opposed flattened lands 68 on opposite surfaces 74 of the screen 60 and located along the screen at the intersections 70.

In addition to the ability to attain lower rates of application of liquid developer upon the roller surface 24, the flattened screen 60 provides further advantages in that the screen has a more uniform predetermined thickness T, as a result of the elimination of minor creases and dents. The screen 60 tends to lie flatter than before and is easier to handle during fabrication of apparatus 10. The diminished tendency to form impressions in the roller surface 24 increases the life of the screen and the roller, while enabling smoother operation. Furthermore, the ability to reduce liquid developer application rates by flattening a coarser mesh screen to obtain the performance of a finer mesh screen enables the use of less expensive coarser mesh screens as the basis for a metering screen 60. For example, a 200 mesh screen, which has an initial thickness of 0.0046 inch, can be flattened, under 5200 pounds of compression between precision rollers, to 0.0030 inch to provide the same performance as that of a more expensive 325 mesh screen. The cost of the 200 mesh screen is one-third the cost of the 325 mesh screen. Thus, the flattened screen 60 provides added flexibility in attaining the reliable application of smaller amounts of liquid developer to roller surface 24 and can provide added economy in the manufacture of apparatus 10.

Returning now to FIG. 1, it will be seen that the metering blade assembly 40 is oriented in a generally upwardly slanted direction, relative to the horizontal axis of rotation of applicator roller 16. In this manner, excess liquid developer at 80 tends to flow downwardly, in the direction of arrow 82, to return to the puddle 42. Any tendency for the excess liquid developer to bypass the metering blade assembly 40 and become deposited on the roller surface 24 to be carried to area 26 is defeated by the gravitational flow of excess liquid developer downwardly to the puddle 42 and thence over the ends 46 of tray 36 to the reservoir 28.

It is noted that the inlet tube 34 discharges liquid developer 30 to puddle 42 at a location 84 placed between puddle 42 and metering blade assembly 40. Such placement of location 84 departs from other arrangements wherein the puddle of liquid developer is located between the inlet and the metering blade assembly. It has been found that the surface of the applicator roller tends to act as a pump, pulling liquid developer from the puddle. In the other arrangements, the pumping action of the roller surfaces could tend to deplete the puddle at higher speeds of rotation of the applicator roller, thereby tending to starve the ends of the applicator roller. By placing the inlet location 84 between puddle 42 and metering blade assembly 40, the pumping action of the surface 24 of applicator roller 16 opposes the tendency of excess liquid developer at 80 to flow downwardly, in the direction of arrow 82, and the inlet flow of liquid developer in the direction of arrow 86, thereby encouraging uniform spreading of the puddle 42 and concomitant uniformity of application of liquid developer to the surface 24 of roller 16. Location 84 preferably is placed generally centrally between the ends of the applicator roller to enhance further the uniform spreading of the liquid developer 30 in puddle 42.

It is to be understood that the above detailed description of an embodiment of the invention is provided by way of example only. Various details of design and construction may be modified without departing from the true spirit and scope of the invention as set forth in the appended claims.

We claim:

1. Apparatus for developing exposed diazotype sheet material by applying a predetermined small amount of liquid developer to the sheet material, said apparatus comprising:

a frame;

an applicator roller mounted for rotation in a given direction upon the frame, said roller having a generally cylindrical surface;

a metering blade assembly mounted upon the frame and urged against the surface of the applicator roller;

means for supplying liquid developer at a first area of the roller surface located before the metering blade assembly in a direction opposite to said given direction; and means for urging the sheet material against a second area of the roller surface located beyond the metering blade assembly in said given direction;

said metering blade assembly including a fine mesh screen biased into direct contact with a portion of the roller surface between the first and second areas for metering the supplied liquid developer to establish an accurately determined amount of liquid developer upon the surface of the roller as the surface passes across the screen;

said fine mesh screen including opposite surfaces, filaments intersecting at intersections along the screen, opposed flattened lands on said opposite surfaces and located on the filaments at intersections thereof, and a predetermined thickness between said opposed flattened lands.

2. The invention of claim 1 wherein the metering blade assembly includes:

a flexible support member; and a resilient backing member carried by the support member;

said fine mesh screen being carried by the resilient backing member and being resiliently urged against said portion of the roller surface by the resilient backing member.

3. The invention of claim 1 wherein the roller surface is essentially smooth.

4. The invention of claim 1 wherein the applicator roller is mounted for rotation about a generally horizontal axis of rotation and the metering blade assembly extends in a generally upwardly slanted direction.

5. The invention of claim 4 wherein the means for supplying liquid developer includes:

puddle-supporting means for supporting a puddle of liquid developer at the first area of the roller surface; and inlet means located between the puddle-supporting means and the metering blade assembly for supplying liquid developer to the puddle.

6. The invention of claim 1 wherein the roller surface is essentially smooth and the metering blade assembly includes:

a flexible support member; and a resilient backing member carried by the support member;

said fine mesh screen being carried by the resilient backing member and being resiliently urged against said portion of the roller surface by the resilient backing member.

7. The invention of claim 6 wherein the screen is a woven material having orthogonal filaments of given diameter and the predetermined thickness between the opposed flattened lands is less than two filament diameters.

8. The invention of claim 7 wherein the filaments are fabricated of a metal, such as stainless steel.

9. The invention of claim 8 wherein the applicator roller is mounted for rotation about a generally horizontal axis of rotation and the metering blade assembly extends in a generally upwardly slanted direction.

10. The invention of claim 9 wherein the means for supplying liquid developer includes:

puddle-supporting means for supporting a puddle of liquid developer at the first area of the roller surface; and inlet means located between the puddle-supporting means and the metering blade assembly for supplying liquid developer to the puddle.

* * * * *